US008268101B2

(12) United States Patent
Conrad et al.

(10) Patent No.: US 8,268,101 B2
(45) Date of Patent: Sep. 18, 2012

(54) AUSTENITIC STAINLESS STEEL STRIP HAVING A BRIGHT SURFACE FINISH AND EXCELLENT MECHANICAL PROPERTIES

(75) Inventors: Francois Conrad, Bethune (FR); Christian Proudhon, Marly sur Arroux (FR); Patrick Borgna, Gueugon (FR)

(73) Assignee: Aperam Stainless France, Saint Denis (FR)

( * ) Notice: Subject to any disclaimer, the term of this patent is extended or adjusted under 35 U.S.C. 154(b) by 594 days.

(21) Appl. No.: 11/994,275

(22) PCT Filed: Apr. 6, 2006

(86) PCT No.: PCT/FR2006/000785

§ 371 (c)(1),
(2), (4) Date: Jul. 24, 2008

(87) PCT Pub. No.: WO2007/003725

PCT Pub. Date: Jan. 11, 2007

(65) Prior Publication Data

US 2009/0202380 A1 Aug. 13, 2009

(30) Foreign Application Priority Data

Jun. 28, 2005 (EP) ..... 05291384

(51) Int. Cl.

| | |
|---|---|
| ***C21D 6/00*** | (2006.01) |
| *C23C 8/06* | (2006.01) |
| *C22C 38/42* | (2006.01) |
| *C22C 38/40* | (2006.01) |

(52) U.S. Cl. ..... 148/611; 148/282; 420/49; 420/97

(58) Field of Classification Search ..... 148/282, 148/611; 420/49, 97

See application file for complete search history.

(56) References Cited

U.S. PATENT DOCUMENTS

| | | | | |
|---|---|---|---|---|
| 4,386,972 | A * | 6/1983 | Knight | 148/218 |
| 5,242,509 | A * | 9/1993 | Rancon et al. | 148/206 |
| 5,830,291 | A | 11/1998 | McGuire et al. | |
| 5,976,282 | A * | 11/1999 | Fukuda et al. | 148/606 |
| 6,230,534 | B1 * | 5/2001 | Sato et al. | 72/252.5 |
| 2005/0167007 | A1 * | 8/2005 | Miura et al. | 148/333 |

FOREIGN PATENT DOCUMENTS

| | | | |
|---|---|---|---|
| FR | 2864108 | * | 6/2005 |
| JP | 5 25548 | | 2/1993 |
| JP | 05317910 | A * | 12/1993 |
| JP | 11 80906 | | 3/1999 |
| JP | 2004 137538 | | 5/2004 |

OTHER PUBLICATIONS

"ASM Handbook: Properties and Selection: Irons, Steels, and High-Proformance Alloys", ASM International, vol. 1, pp. 843 and 854 (1990).

* cited by examiner

*Primary Examiner* — Jessica L Ward
*Assistant Examiner* — Alexander Polyansky
(74) *Attorney, Agent, or Firm* — Oblon, Spivak, McClelland, Maier & Neustadt, L.L.P.

(57) ABSTRACT

The invention relates to an austenitic stainless steel strip having an elastic limit $Rp_{0.2}$ which is greater than or equal to 600 MPa, a breaking load Rm which is greater than or equal to 800 MPa, an elongation $A_{80}$ which is greater than or equal to 40% and a bright surface finish of the bright annealed type. The invention also relates to a method for the continuous production of said austenitic stainless steel strip.

14 Claims, No Drawings

AUSTENITIC STAINLESS STEEL STRIP HAVING A BRIGHT SURFACE FINISH AND EXCELLENT MECHANICAL PROPERTIES

The present invention relates to an austenitic stainless steel strip having an offset yield strength $Rp_{0.2}$ greater than or equal to 600 MPa, an ultimate tensile strength Rm greater than or equal to 800 MPa, an elongation $A_{80}$ greater than or equal to 40% and a bright surface finish of the bright-annealed type. The invention also relates to a method for continuous manufacture of this austenitic stainless steel strip.

Because of their very good cold-forming capacity characterized by high mechanical strength and ductility, their good weldability and excellent corrosion resistance, the austenitic stainless steels are used in a broad range of final applications, such as the manufacture of mechanical parts, cooking utensils and tubes.

Depending on the intended application of the austenitic stainless steel strip, it is subjected to heat treatment and final pickling that, depending on the operating conditions, imparts to it either a surface finish exhibiting high gloss, of interest, for example, in flatware, or a matt surface finish, of interest for manufacture of building facades. According to the invention, the gloss corresponds to the measurement of surface reflectance. Within the scope of the invention, the gloss is measured at a surface illumination angle of 60°, according to International Standard ISO 7668 (1986). Within the scope of the present invention, a bright surface finish is understood as a surface having a gloss, measured at 60°, of greater than 50, and a matt surface finish is understood as a surface having a gloss, measured at 60°, of lower than 20.

Conventionally, to obtain a bright surface finish, the austenitic stainless steel strip is cold-rolled beforehand with cylinders that impart a bright surface finish to the strip. Thereafter the cold-rolled strip is degreased and rinsed, then is subjected to heat treatment in a vertical furnace described as "bright-annealing", in which a reducing atmosphere prevails. For this purpose, the strip passes into the furnace composed of a chamber completely insulated from the outside atmosphere, comprising three zones in which a neutral or reducing gas circulates. This gas is chosen from among hydrogen, nitrogen or a mixture of hydrogen and nitrogen (HNX gas), for example, and it has a dew point of between −60 and −45° C. The strip is first heated in the first furnace zone to a temperature of between 1050 and 1150° C., at a heating rate of 30 to 60° C./s. It is then maintained at this temperature in the second furnace zone for a period sufficient to permit recrystallization of the steel and restoration of the mechanical properties. Finally, in the third furnace zone, it is cooled to a temperature on the order of 150° C., in order to avoid any reoxidation of the surface of the strip with oxygen from the air when the strip exits the furnace chamber.

At the furnace outlet, the bright surface finish imparted to the strip during cold rolling is maintained, because the oxide film formed during annealing is very thin, with a thickness on the order of 10 angstrom.

Nevertheless, the use of this type of furnace is complex and laborious, especially by reason of the use of gas such as hydrogen and/or nitrogen and the necessity of maintaining a controlled atmosphere having constant dew point in the furnace chamber.

In addition, in the case of bright-annealing treatment of the austenitic stainless steel strip under a gaseous atmosphere containing hydrogen, the mechanical properties of the steel are degraded, because the hydrogen favors the development of cracks in certain zones of parts obtained by stamping the strip. This hydrogen embrittlement is more pronounced the higher the annealing temperature and the greater the hydrogen content of the HNX mixture.

Another means of manufacturing an austenitic stainless steel strip having a bright surface finish consists in subjecting the strip to a final treatment of pickling annealing, which imparts thereto a pickled-annealed surface finish, or in other words a matt surface finish, and then proceeding to an operation in which either the surface of the strip is polished or the strip is skin-passed.

An austenitic stainless steel strip having a surface finish of pickled-annealed type is obtained by proceeding as follows. The strip, cold-rolled beforehand, is subjected to continuous annealing at a temperature on the order of 1100° C. for approximately 1 minute in a furnace, in which the thermal energy is generated by combustion of hydrocarbons in which the admission of air to the burner is regulated so as to obtain an oxidizing atmosphere. In fact, it is ensured that the strip cannot be exposed to a reducing atmosphere, or in other words an atmosphere containing excess hydrocarbons, in order to prevent degradation of the corrosion resistance of the strip by recarburization of the steel by the hydrocarbons. The strip is then subjected to cooling in air and/or to forced cooling by sprinkling water outside the furnace. Finally, it is subjected to pickling suitable for eliminating the thick layer, on the order of 0.1 to 0.3 μm, of oxide formed on the surface of the strip during annealing in the furnace. Pickling is generally carried out in a plurality of pickling vats containing acid solutions capable of eliminating this oxide layer, such as a mixture of nitric acid and hydrofluoric acid.

Finally, the strip is subjected to a skin-pass operation, or in other words a polishing operation, until the desired bright surface finish is obtained. The skin-pass operation is achieved with what are known as mirror-polish working cylinders, or in other words cylinders having an arithmetic average roughness Ra of between 0.05 and 0.08 μm, which impart a bright surface finish to the steel strip.

However, the austenitic stainless steel strips obtained according to these two methods have insufficient mechanical characteristics, since their offset yield strength $Rp_{0.2}$ is between 250 and 350 MPa and their ultimate tensile strength Rm is between 600 and 700 MPa, for an elongation $A_{80}$ of between 50 and 60%. Finally, the skin-pass or polishing operation constitutes an extra step. In addition, the polishing operation is a long and difficult operation.

The objective of the present invention is therefore to avoid the disadvantages of the prior art methods and to provide a method capable of imparting, to an austenitic stainless steel strip treated in a hydrocarbon combustion furnace, a bright surface finish, an offset yield strength $Rp_{0.2}$ of 600 MPa and an ultimate tensile strength of 800 MPa, together with an elongation $A_{80}$ of greater than or equal to 40%.

For this purpose, the object of the invention is an austenitic stainless steel strip having an offset yield strength $Rp_{0.2}$ of greater than or equal to 600 MPa, an ultimate tensile strength Rm of greater than or equal to 800 MPa, an elongation $A_{80}$ of greater than or equal to 40%, and a composition in wt % of:

$0.025 \leqq C \leqq 0.15\%$
$0.20 \leqq Si \leqq 1.0\%$
$0.50 \leqq Mn \leqq 2.0\%$
$6.0 \leqq Ni \leqq 12.0\%$
$16.0 \leqq Cr \leqq 20.0\%$
$Mo \leqq 3.0\%$
$0.030 \leqq N \leqq 0.160\%$
$Cu \leqq 0.50\%$
$P \leqq 0.50\%$
$S \leqq 0.015\%$ if necessary, $0.10 \leqq V \leqq 0.50\%$ and $0.03 \leqq Nb \leqq 0.50\%$ with $0.10 \leqq Nb+V \leqq 0.50\%$ the rest being iron and possible impurities resulting from smelting, wherein the mean size of the austenite grains is smaller than or equal to 4 μm and the surface has a gloss, measured at 60°, of greater than 50.

The steel strip according to the invention advantageously has a surface whose arithmetic average roughness is smaller than or equal to 0.08 μm, thus imparting to the strip a smooth surface and therefore an even brighter surface finish.

Another object of the invention is a method for continuous manufacture of this austenitic stainless steel strip.

The characteristics and advantages of the present invention will become more apparent in the description hereinafter, given by way of non-limitative example.

To obtain an austenitic stainless steel strip according to the invention, it is necessary first to smelt and then to cast, in the form of a slab, an austenitic stainless steel comprising the following elements:

carbon in a content of between 0.025 and 0.15 wt %. Carbon favors the formation of austenite and controls the quantity and hardness of the strain-induced martensite. In addition, when present in the form of solid solution, it hardens the steel and increases its mechanical strength. If the carbon content is lower than 0.025%, the steel becomes unstable and much martensite is formed, leading to insufficient elongation $A_{80}$. On the other hand, if the carbon content is higher than 0.15%, the steel becomes stable, the formation of strain-induced martensite is insufficient and the steel no longer has enough energy to recrystallize. Consequently, the minimum annealing temperature to initiate recrystallization is elevated and the size of the austenite grains becomes too large to attain superior mechanical characteristics. In addition, even higher carbon contents favor the formation of chromium carbides at the grain boundaries during subsequent heat treatments, thus increasing the risks of intergranular corrosion.

silicon in a content of between 0.20 and 1.0 wt %. Silicon is used to deoxidize the molten steel, and it participates in hardening when present in solid solution. Its content is limited to 1.0 wt %, since it tends to disturb the method of manufacturing the steel strip by causing problems of segregation while the steel is being cast into slabs.

manganese in a content of between 0.50 and 2.0 wt %. Manganese favors the formation of austenite. If the manganese content is higher than 2.0%, the austenite becomes too stable and the formation of strain-induced martensite is insufficient, thus making it impossible to attain the required limits of offset yield strength. However, if the manganese content is lower than 0.50%, deoxidation of the steel is insufficient.

chromium in a content of between 16.0 and 20.0%. Chromium favors the formation of strain-induced martensite, and it is an essential element for imparting good corrosion resistance to the steel. If the chromium content is higher than 20.0%, too much strain-induced martensite is generated, making it necessary to increase the content of elements such as carbon, nitrogen, nickel and manganese, which favor the formation of austenite. If the chromium content is lower than 16.0%, the corrosion resistance of the steel is insufficient.

nickel in a content of between 6.0 and 12.0%. Nickel stabilizes the austenite and favors re-passivation. If the nickel content is lower than 6.0%, the corrosion resistance of the steel is insufficient. If the nickel content is higher than 12.0%, the austenite is excessively stabilized, strain-induced martensite is no longer sufficiently formed, and the mechanical characteristics of the steel are insufficient.

molybdenum in a content of lower than or equal to 3.0%. Molybdenum favors the formation of strain-induced martensite and increases the corrosion resistance, especially if it is combined with nitrogen. Above a content of 3.0%, the corrosion resistance of the steel will not be improved.

nitrogen in a content of between 0.030 and 0.160%. Nitrogen favors the formation of austenite, retards the precipitation of carbides, stabilizes the austenite and improves formability. In addition, it plays a role in control of the size of the grains in the structure. However, if it is added in a content of higher than 0.160%, there is a risk that the hot ductility of the steel will deteriorate.

copper in a content of lower than or equal to 0.50%. Copper favors the formation of austenite and contributes to the corrosion resistance. However, above a content of 0.50%, the proportion of copper that is not in solid solution in the austenite increases, and the hot formability of the steel deteriorates.

phosphorus in a content of lower than or equal to 0.50%. Phosphorus is a segregating element. In solid solution it favors hardening of the steel, but its content must be limited to 0.50%, because it increases the brittleness of the steel and its weldability.

sulfur in a content of less than or equal to 0.015%. Sulfur is also a segregating element, whose content must be limited in order to prevent cracks during hot rolling.

In addition, the composition may if necessary include:

vanadium in a content of between 0.10 and 0.50%. Vanadium favors the weldability of the steel and retards the growth of austenite grains in the heat-affected zone. Above 0.50%, vanadium does not contribute to the improvement of weldability, and below 0.10% the weldability of the steel is insufficient.

niobium in a content of between 0.03 and 0.50%. Niobium favors the weldability of the steel, but above 0.50% it degrades the hot formability of the steel strip.

with a total niobium plus vanadium content of between 0.10 and 0.50%, to guarantee the weldability of the steel without detrimental effect on the hot ductility.

The rest of the composition is made up of iron and other elements that are normally expected to be present as impurities resulting from smelting of the stainless steel, in proportions that do not influence the sought properties.

Once it has been cast, the slab is hot rolled in a strip mill to form a hot-rolled strip, which is annealed and if necessary pickled.

The hot-rolled strip is then subjected to diverse treatments, so as to obtain a strip that simultaneously exhibits excellent mechanical characteristics and a bright surface finish, without having to resort to annealing in a bright-annealing furnace or to final polishing of the surface of the strip or to a final skin-pass operation.

The installation used to manufacture the strip according to the invention comprises a device for cold-rolling of strip, composed of a strip mill comprising working cylinders, between which there is passed the austenitic stainless steel strip having a composition according to the invention. The working cylinders have an arithmetic average roughness Ra of smaller than or equal to 0.15 μm and preferably smaller than or equal to 0.10 μm. The diameter of the working cylinders of the strip mill is between 50 and 100 mm, to minimize the rolling forces for high reduction ratios, or in other words for reduction of 75% and greater. The strip mill makes it possible not only to reduce the thickness of the strip but also to favor flattening of the irregularities resulting from the previous hot-rolling of the strip.

Downstream from the hot-rolling device, the installation includes a hydrocarbon combustion furnace having an open chamber, through which the strip passes, and means for introducing a gaseous mixture of hydrocarbon and air. The open chamber is provided in the indicated direction of travel of the strip with two successive zones, a first heating zone and a second temperature-holding zone.

The first heating zone is equipped with powerful heating means (not illustrated) capable of rapidly heating the strip, at a heating rate V1, to a holding temperature T1. The strip is maintained at this temperature T1 in the second zone for a holding time M, then it is cooled at a rate V2 in a cooling zone situated just downstream from the furnace outlet.

Finally, downstream from the cooling zone, the installation includes a pickling device, which is provided with at least one acid-resistant pickling vat containing a pickling solution.

According to the invention, the austenitic steel strip that has been hot-rolled beforehand is cold-rolled at ambient temperature, with a reduction ratio of between 55 and 85%. In this way there is obtained a cold-rolled strip having a thickness of between 0.6 and 2 mm.

During the cold-rolling operation at a reduction ratio of between 55 and 85%, strain-induced α'-martensite is formed in a proportion of between 50 and 90 vol%. The strain-induced α'-marteniste is observed by micrography, and its volume fraction can be measured by x-ray diffraction or magnetic induction measurement (ferromagnetic phase).

When the reduction ratio is lower than 55%, the proportions of strain-induced α'-martensite and of dislocation martensite are insufficient to impart the required mechanical characteristics to the stainless steel according to the invention. In fact, when the reduction ratios are too low, the strain energy stored in the volume does not permit homogeneous recrystallization of the steel such that austenite grains having a mean size smaller than or equal to 4 μm are obtained.

To obtain a high offset yield strength $Rp_{0.2}$, it is advisable to carry out recrystallization annealing, with which austenite grains whose mean size does not exceed 4 μm can be obtained. In fact, it is known from the Hall-Petch equation that the offset yield strength $Rp_{0.2}$ is inversely proportional to the square root of the grain size. In addition, a fine-grained structure, or in other words a structure in which the mean size of the austenite grains does not exceed 4 μm, significantly resists the matting phenomenon (loss of gloss) during cold-forming operations such as stamping, as will be seen hereinafter.

In addition, from the viewpoint of surface gloss after cold-rolling, reduction ratios lower than 55% do not permit the surface finish of the previously hot-rolled strip to be restored. Consequently, shot-blasting pits or residues of intergranular corrosion caused by the operations of mechanical and chemical descaling preceding cold-rolling and following hot-rolling continue to exist. A reduction ratio of larger than 55% makes it possible to decrease the density of micro-defects of the type of shot-blasting pits and/or grain boundaries and in this way to obtain a surface finish exhibiting homogeneous and high gloss after cold-rolling.

However, when the cold-rolling ratio is greater than 85%, the stresses imposed on the working cylinders are too great, and it is no longer possible to roll the strip. In addition, the risk of development of micro-defects of the "heat marks" type due to excessive shear stresses at the interface between the cylinder and cold-rolled strip becomes too great.

Preferably the reduction ratio is between 70 and 85%, so as to obtain a strip exhibiting smooth surface topography, or in other words an arithmetic average roughness Ra of between 0.07 and 0.12 μm, free of micro-defects of the type of shot-blasting pits and/or chemically etched grain boundaries. This makes it possible in addition to store sufficient plastic strain energy to favor faster recrystallization at low temperature.

The applicants wish to emphasize that the achievement of a bright surface finish by an oxidizing annealing treatment followed by pickling instead of by a classical bright annealing method was contrary to the initial expectations of the inventors, who expected, on the basis of their theory, to obtain a strip having a matt surface finish with low gloss, characteristic of steels annealed in a hydrocarbon combustion furnace. In fact, on the basis of their theory, the inventors believed that the limitation of grain size growth in terms of volume achieved by controlled recrystallization of an austenitic stainless steel, while increasing the surface density of chemically etched grain boundaries, would favor diffuse reflection of light at the surface and therefore the production of a matt and not bright surface.

Now, the inventors disclosed that, when the strip is cold-rolled with a sufficiently high reduction ratio and with working cylinders having an arithmetic average roughness Ra smaller than or equal to 0.15 μm, then subjected to partial recrystallization annealing at a temperature on the order of 800° C. in a hydrocarbon combustion furnace, to form an oxide layer sufficiently thin that it can be easily eliminated by acid pickling without etching the grain boundaries, then the strip exhibits not only excellent mechanical characteristics but also a bright surface finish of the bright-annealed type.

Under the conditions of the invention, or in other words in the absence of etching of the grain boundaries of the steel, the arithmetic average roughness Ra transferred to the strip by the working cylinders during the cold-rolling operation is degraded only very slightly. Thus, to obtain a strip having a gloss of greater than 50 when measured with an illumination angle of 60°, it is essential that the working cylinders have an arithmetic average roughness of smaller than or equal to 0.15 μm, and preferably smaller than 0.10 μm. The gloss measured within the scope of the present invention corresponds to the measurement of surface reflectance and is measured at an illumination angle of 60°, in accordance with International Standard ISO 7668 (1986).

According to the invention, the cold-rolled strip is then passed into the open chamber of the hydrocarbon combustion furnace, inside which there prevails an atmosphere that is oxidizing toward iron, in order to subject it to a heat treatment consisting in partial recrystallization annealing of the steel, followed by forced cooling.

The atmosphere prevailing in the furnace is composed of a gaseous mixture of air and of at least one hydrocarbon in an air/hydrocarbon volume ratio of between 1.1 and 1.5, the gaseous mixture additionally containing 3 to 8 vol % of oxygen. The furnace atmosphere is preferably a gaseous mixture of air and hydrocarbon in an air/hydrocarbon volume ratio of between 1.1 and 1.5, wherein the gaseous mixture additionally contains 3 to 8 vol % of oxygen.

The at least one hydrocarbon is chosen from among natural gas, butane and methane. Natural gas is preferably chosen by virtue of its low cost and its ease of transportation.

If the air/hydrocarbon volume ratio is greater than 1.5, the atmosphere prevailing in the annealing furnace is too oxidizing, and the oxide layer formed is so thick that in order to eliminate it, it will be necessary to use aggressive pickling solutions, which will etch the grain boundaries. The surface finish of the strip will then be matt.

However, if the air/hydrocarbon volume ratio is lower than 1.1, the atmosphere prevailing in the annealing furnace is too reducing. Consequently, it will not be possible to prevent re-carburization of the steel by the hydrocarbons, and the corrosion resistance of the steel will be degraded.

To obtain a strip whose surface has a bright finish, care must be taken to control the heat-treatment conditions in such a way as to obtain a strip covered by an oxide layer whose thickness is smaller than 0.10 μm. In fact, if the oxide thickness is greater than or equal to 0.10 μm, it will be necessary, in order to remove this thick oxide layer, to use aggressive pickling acids, which will etch the grain boundaries, thus imparting a matt surface finish to the strip.

To obtain the required mechanical characteristics, the heat treatment is adjusted so as to obtain a steel strip whose recrystallized volume fraction is between 60 and 75%. In fact, if the non-recrystallized volume fraction (measured by micrographic observation and image analysis) is greater than 40%, the microstructure of the steel induces excessively high values of the mechanical properties, and the elongation $A_{80}$ of the strip is smaller than 40%. On the other hand, if the non-recrystallized volume fraction is smaller than 25%, the mechanical characteristics, such as the offset yield strength $Rp_{0.2}$, will be insufficient.

Preferably the partial recrystallization annealing is carried out at a rate V1 of between 10 and 80° C./s, a temperature T of between 800 and 950° C. and a holding time M of between 10 and 100 seconds, advantageously between 60 and 80 seconds.

The annealing of the strip at a temperature T of between 800 and 950° C. makes it possible to limit diffusion of chromium to the grain boundaries and consequently limits etching of the grain boundaries during subsequent chemical pickling of the strip, which favors production of a bright surface finish.

When the temperature T is lower than 800° C., the steel does not crystallize sufficiently to obtain the sought mechanical properties. In effect, the steel has an offset yield strength $Rp_{0.2}$ of higher than 600 MPa but a poor elongation $A_{80}$ of lower than 40%, which greatly limits its cold-forming capacities.

When the temperature T is higher than 950° C., not only is the offset yield strength $Rp_{0.2}$ of the strip insufficient by reason of the enlargement of austenite grains to the benefit of the martensite, which disappears completely, but also the surface gloss of the strip decreases, because the oxide layer becomes larger.

When the rate of heating V1 of the strip is slower than 10° C./s, the stainless steel can recrystallize only during a very long holding time M, which is not compatible with the industrial requirements. On the other hand, the austenite grains become larger to the benefit of the martensite, and the offset yield strength $Rp_{0.2}$ is insufficient to impart good mechanical properties to the stainless steel.

If the holding time M at the temperature T is shorter than 10 seconds, the recrystallized volume fraction of the strip will be smaller than 60% and the elongation $A_{80}$ of the strip is insufficient. On the other hand, beyond 100 seconds, the austenite grains become larger to the benefit of the martensite, and the mechanical characteristics such as the offset yield strength $Rp_{0.2}$ become insufficient.

The partly recrystallized steel strip is then subjected to forced cooling at a rate V2 of between 10 and 80° C./s, for example by blowing in air or by blowing in air under pressure and spraying water. When the cooling rate V2 is faster than 10° C./s, the offset yield strength $Rp_{0.2}$ and the ultimate tensile strength increase.

When the strip is cooled, it is subjected to pickling using an acid pickling solution capable of completely eliminating the said oxide layer as a function of its thickness and its nature, without etching the grain boundaries of the steel.

For example, the strip is subjected to a first electrolytic pickling in a solution containing sodium sulfate in a concentration of between 150 and 200 g/L, with a pH of lower than 3, at a current of between 5 and 12 kA.

It is then subjected to a second electrochemical pickling in a solution containing nitric acid in a concentration of between 80 and 120 g/L, with a pH of lower than 3, at a current of between 5 and 12 kA.

The strip according to the invention additionally has the following advantages:

- Better resistance of the gloss after deformation than austenitic stainless steel strips that were subjected to annealing in a bright-annealing furnace (standard 2BA). In effect, the loss of gloss of the strip according to the invention is only 30% after stamping, whereas it is 80% for the standard bright-annealed strip.
- Better resistance to intergranular corrosion than austenitic stainless steel strips that were subjected to a treatment of standard pickling-annealing type (standard 2D).
- Better resistance to scratching than standard bright-annealed austenitic stainless steel strips (standard 2BA).
- A Vickers hardness $HV_5$, measured by indentation, greater than that of austenitic stainless steel strips that were subjected to a treatment of standard pickling-annealing type (standard 2D), and than that of standard bright-annealed austenitic stainless steel strips (standard 2BA).

In addition, the austenitic stainless steel strips according to the invention have a weldability comparable to that of standard bright-annealed or standard pickled-annealed austenitic stainless steel strips.

The invention will now be illustrated by examples, which are given by way of indication and are non-limitative.

Firstly, the mechanical characteristics and gloss of an austenitic stainless steel strip according to the invention will be compared on the one hand with an austenitic stainless steel strip of standard pickled-annealed type (standard 2D) and on the other hand with an austenitic stainless steel strip of standard bright-annealed type (standard 2BA). The measurement of gloss is achieved with illumination at 60° in accordance with International Standard ISO 7668 (1986).

Then the stampability of these three types of strip, their loss of gloss after stamping, their scratch resistance and finally their intergranular corrosion resistance will be compared.

For that purpose, a steel strip according to the invention, a standard 2D strip and a standard 2BA strip first will be manufactured from the same austenitic stainless steel grade AS33, whose chemical composition is presented in Table 1 below.

Table 1: Chemical composition of the stainless steel according to the invention, expressed in wt %, the rest being iron and inevitable impurities.

TABLE 1

| C | Si | Mn | Ni | Cr | Mo | N | Cu | P | S | V | Nb |
|---|---|---|---|---|---|---|---|---|---|---|---|
| 0.055 | 0.51 | 1.25 | 8.03 | 18.1 | 0.15 | 0.045 | 0.41 | 0.03 | 0.002 | 0.11 | 0.03 |

1—Manufacture of the Strip According to the Invention

Steel AS33 is cast to form a slab, which is hot-rolled to attain a thickness of 4.5 mm. This slab is then cold-rolled with working cylinders having an arithmetic average roughness Ra of 0.1 μm, with a reduction ratio of 82%, so as to obtain a strip of 0.8 mm thickness in one pass.

This cold-rolled strip is subjected to partial recrystallization annealing of the steel in a combustion furnace, by heating it at a heating rate of 50° C./s, to a holding temperature of 820° C. for a holding time of 50 seconds. The atmosphere prevailing in the furnace is a mixture of air and natural gas containing an oxygen proportion of 4 vol %. The air/natural gas volume ratio is 1.3.

The strip is then cooled to ambient temperature at a cooling rate of 70° C./s.

After cooling, an oxide layer of 0.08 μm thickness is formed on the surface of the strip.

Finally, the strip is subjected to a first electrolytic pickling in a solution containing sodium sulfate in a concentration of 175 g/L, with a pH of 2, at a current of 9 kA, for a duration of 15 s, then to a second electrochemical pickling in a solution containing nitric acid in a concentration of 100 g/L, with a pH of 2, at a current of 9 kA, for a duration of 15 s.

The obtained strip is not subjected to any other subsequent treatment, neither surface polishing nor skin-pass.

2—Manufacture of the Standard 2D Strip of Matt Surface Finish

Steel AS33 is cast to form a slab, which is hot-rolled to attain a thickness of 4.5 mm. This slab is then cold-rolled with a reduction ratio of 82%, so as to obtain a strip of 0.8 mm thickness in one pass.

This cold-rolled strip is subjected to complete recrystallization annealing of the steel in a combustion furnace, at a temperature of 1120° C. for a time of 50 seconds. The atmosphere prevailing in the furnace is a mixture of air and natural gas containing an oxygen proportion of 4 vol %. The air/natural gas volume ratio is 1.3.

The strip is then cooled to ambient temperature at a cooling rate of 80° C./s.

Finally, the strip is subjected to pickling in order to completely eliminate the formed oxide layer of 0.2 μm thickness, in solutions of sodium sulfate and sulfuric acid.

The obtained strip is not subjected to any other subsequent treatment, neither surface polishing nor skin-pass.

3—Manufacture of the Standard 2BA Strip

Steel AS33 is cast to form a slab, which is hot-rolled to attain a thickness of 4.5 mm. This slab is then cold-rolled with working cylinders that impart a bright surface finish to the strip, with a reduction ratio of 82%, so as to obtain a strip of 0.8 mm thickness in one pass.

This cold-rolled strip is subjected to complete recrystallization annealing of the steel in a bright-annealing furnace, in the inside of which there prevails an atmosphere composed of a gaseous mixture comprising 10 vol % of nitrogen and 90 vol % of hydrogen and having a dew point of −50° C., by heating it at a heating rate of 50° C./s to a holding temperature of 1100° C.

Finally, the strip is cooled to ambient temperature at a cooling rate of 60° C./s.

The obtained strip is not subjected to any other subsequent treatment, neither surface polishing nor skin-pass.

Table 2 shows the mechanical characteristics and finish of these three types of strip.

TABLE 2

| | Standard 2D strip | Standard 2BA strip | Strip according to the invention |
|---|---|---|---|
| Mechanical characteristics | | | |
| Offset yield strength Rp 0.2 (MPa) | 312 | 308 | 596 |
| Ultimate tensile strength Rm (MPa) | 656 | 677 | 796 |
| Elongation A80 (%) | 59 | 59 | 42 |
| Grain size (μm) | 12 to 25 | 15 to 20 | 1 to 4 |
| Finish characteristics | | | |
| Gloss (60°, long direction) | 21 | 55 | 50 |
| Arithmetic average roughness Ra (μm) | 0.12 | 0.12 | 0.07 |
| Surface hardness ($HV_5$) | 169 | 172 | 286 |

Compared with the standard 2D and standard 2BA strips, the strip according to the invention simultaneously exhibits a bright surface finish and good mechanical characteristics. In addition, it has surface hardness superior to that of the two prior art strips.

4—Stampability and Consequences for Gloss

Blanks are cut out from the steel strip according to the invention, from the standard 2BA strip and from the standard 2D strip. These blanks are then stamped in a stamping press, traditionally comprising a punch, a die and a blank-clamping means, to form cups.

After the operation of forming by stamping, the surface gloss, measured at an illumination angle of 60°, is measured both at the bottom of the cup and shell of the cup, thus making it possible to estimate a mean gloss value for the stamped part.

The results are presented in Table 3.

TABLE 3

| | Standard 2D strip | Standard 2BA strip | Strip according to the invention |
|---|---|---|---|
| Gloss of the strip at 60° | 21 | 55 | 50 |
| Gloss in the bottom of the cup at 60° | 7 | 7 | 34 |
| Gloss on the shell of the cup at 60° | 10 | 13 | 35 |
| Mean gloss of the cup at 60° | 8.5 | 10 | 34.5 |
| Relative loss of gloss after stamping (%) | 52 | 81 | 30 |

Compared with the gloss of the flat product, there is traditionally observed a loss of gloss of cold-formed parts. The tests performed on the different studied types of strips studied show that the austenitic stainless steel strip according to the invention is more resistant to matting of the surface by deformation than are the standard 2D and standard 2BA strips.

After stamping of the steel strip according to the invention, the loss of gloss is slight and much smaller than what is observed for the standard 2D and standard 2BA strips.

5—Scratch Resistance

The scratch resistance tests are performed on the steel strip according to the invention and on the standard 2BA strip according to International Standard ISO 1518, using a Clemen machine whose hemispherical tip of quenched steel has a hardness of 1500 HV and a diameter of 1 mm. The tests consist of applying the hemispherical tip to the surface of the strip under variable loads of 50 g, 200 g and 400 g, in such a way as to create a scratch. The test results are presented in Table 4.

TABLE 4

| Load (g) | Depth (μm) of the scratch for the standard 2BA strip | Depth (μm) of the scratch for the strip according to the invention | Relative difference (%) |
|---|---|---|---|
| 50 | 1.08 | 0.73 | 32 |
| 200 | 3 | 1.35 | 55 |
| 400 | 3.35 | 2.33 | 30 |

The results of the tests show that the steel strip according to the invention has better scratch resistance than the standard 2BA strips, by a proportion on the order of 40% on average, corresponding to the difference in relative surface hardness of the strip.

6—Resistance to Intergranular Corrosion

The test of resistance to intergranular corrosion is performed on samples taken from the steel strip according to the invention and from the standard 2D strip.

This test is performed according to French Standard NFA 05-159. It consists in immersing the sample in a boiling solution of sulfuric acid and copper sulfate for a duration of 20 hours. The sample is then bent at 90°, after which observation of its convex face and comparison with a reference specimen that has not been immersed in the said solution make it possible to determine the degree of cracking in the outermost skin. Low resistance to intergranular corrosion is characterized by the presence of numerous cracks on the convex face of the bent sample. The tests of intergranular corrosion resistance show that the austenitic steel strip according to the invention has better intergranular corrosion resistance than the standard 2D strip.

The invention claimed is:

1. A method for continuous manufacture of an austenitic stainless steel strip having an offset yield strength $Rp_{0.2}$ of greater than or equal to 600 MPa, an ultimate tensile strength Rm of greater than or equal to 800 MPa, an elongation $A_{80}$ of greater than or equal to 40%, a mean size of austenite grains smaller than or equal to 4 μm and a surface gloss, measured at an illumination angle of 60°, of greater than 50; consisting essentially of:

cold rolling an austenitic stainless steel strip comprising, in wt %:

$0.025 \leqq C \leqq 0.15\%$, $0.20 < Si \leqq 1.0\%$, $0.50 \leqq Mn \leqq 2.0\%$, $6.0 \leqq Ni \leqq 12.0\%$, $16.0 \leqq Cr \leqq 20.0\%$, $Mo \leqq 3.0\%$, $0.030 \leqq N \leqq 0.16\%$, $Cu \leqq 0.50\%$, $P \leqq 0.50\%$, $S \leqq 0.015\%$, if necessary, $0.10 \leqq V \leqq 0.50\%$ and $0.03 \leqq Nb \leqq 0.50\%$ with $0.10 \leqq Nb+V \leqq 0.50\%$ the rest being iron and possible impurities resulting from smelting, the cold rolling being effected with working cylinders having an arithmetic average roughness Ra of smaller than or equal to 0.15 μm;

subjecting the cold-rolled strip to a heat treatment in an annealing furnace, inside which there prevails an atmosphere that is oxidizing toward iron, in order to obtain a strip covered with a layer of oxide, the said heat treatment being adjusted so as to bring about partial recrystallization of the steel to obtain a strip whose recrystallized volume fraction is between 60 and 75%; and pickling the strip that has been subjected to the heat treatment, using at least one acid pickling solution capable of completely eliminating the said oxide layer as a function of its thickness and its nature, without etching the grain boundaries of the steel.

2. A method according to claim 1, characterized in that the arithmetic average roughness Ra of the working cylinders is smaller than or equal to 0.10 μm.

3. A method according to claim 1, characterized in that the strip is cold-rolled with a reduction ratio of between 55 and 85%.

4. A method according to claim 3, characterized in that the reduction ratio is between 70 and 85%.

5. A method according to claim 1, characterized in that said atmosphere of the furnace is a gaseous mixture of air and of at least one hydrocarbon in an air/hydrocarbon volume ratio of between 1.1 and 1.5, the said gaseous mixture additionally containing 3 to 8 vol % of oxygen.

6. A method according to claim 5, characterized in that the air/hydrocarbon volume ratio is between 1.1 and 1.3.

7. A method according to claim 5, characterized in that at least one hydrocarbon is chosen from among natural gas, butane and methane.

8. A method according to claim 1, characterized in that the heat treatment comprises a phase of heating at a heating rate V1, a phase of holding at a temperature T for a holding time M, followed by a phase of cooling at a cooling rate V2.

9. A method according to claim 8, characterized in that the temperature T is between 800 and 950° C.

10. A method according to claim 8, characterized in that the rate V1 is between 10 and 80° C/s.

11. A method according to claim 8, characterized in that the holding time M is between 10 s and 100 s.

12. A method according to claim 8, characterized in that the rate V2 is between 10 and 80° C/s.

13. A method according to claim 1, characterized in that the partly annealed strip is subjected to a first electrolytic pickling in a solution containing sodium sulfate in a concentration of between 150 and 200 g/L, with a pH of lower than 3, at a current of between 5 and 12 kA, followed by a second electrochemical pickling in a solution containing nitric acid in a concentration of between 80 and 120 g/L, with a pH of lower than 3, at a current of between 5 and 12 kA.

14. A method according to claim 1, wherein the austenitic stainless steel strip further includes: $0.10 \leqq V \leqq 0.50\%$ and $0.03 \leqq Nb \leqq 0.50\%$, where $$0.10 \leqq Nb+V \leqq 0.50\%.$$

* * * * *